US006087993A

United States Patent [19]

Anderson et al.

[11] Patent Number: 6,087,993

[45] Date of Patent: Jul. 11, 2000

[54] PLASMA ANTENNA WITH ELECTRO-OPTICAL MODULATOR

[75] Inventors: Theodore R. Anderson, West Greenwich, R.I.; Robert J. Aiksnoras, Salem, Conn.

[73] Assignee: The United States of America as represented by the Secretary of the Navy, Washington, D.C.

[21] Appl. No.: 09/317,086

[22] Filed: May 21, 1999

[51] Int. Cl.[7] ..... H01Q 1/26; H01Q 1/34

[52] U.S. Cl. ..... 343/701; 343/709

[58] Field of Search ..... 343/701, 850, 343/709, 785; 315/111.21, 111.41; H01Q 1/26, 1/34

[56] References Cited

U.S. PATENT DOCUMENTS 3,914,766 10/1975 Moore ..... 343/701

5,594,456 1/1997 Norris ..... 343/701

5,963,169 10/1999 Anderson et al. ..... 343/701

*Primary Examiner*—Hoanganh Le

*Attorney, Agent, or Firm*—Michael J. McGowan; Robert W. Gauthier; Prithvi C. Lall

[57] ABSTRACT

A plasma antenna is provided. An ionizer generates an ionizing beam in a bounded or unbounded plasma column extending along a vertical axis. An amplitude or frequency modulating signal is applied to an electro-optical crystal that amplitude, phase, or frequency modulates the ionizing beam. The resulting changes in the ionizing beam produce gradients in the plasma that cause ions and electrons to oscillate in a vertical path that generates alternating current having the frequency of the modulator. These currents generate an amplitude- or phase-modulated electromagnetic field that radiates from the plasma column.

19 Claims, 3 Drawing Sheets

PLASMA ANTENNA WITH ELECTRO-OPTICAL MODULATOR

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED APPLICATIONS

This patent application is co-pending with two related patent applications entitled STANDING WAVE PLASMA ANTENNA WITH PLASMA REFLECTOR (Attorney Docket No. 78772) and PLASMA ANTENNA WITH TWO-FLUID IONIZATION CURRENT (Attorney Docket No. 78767) filed herewith filed by the first named inventor hereof and assigned to the Assignee hereof.

BACKGROUND OF THE INVENTION (1) Field of the Invention

The present invention relates generally to communications antennas, and more particularly to plasma antennas adaptable for use in any of a wide range of frequencies.

(2) Description of the Prior Art

A specific antenna typically is designed to operate over a narrow band of frequencies. However, the underlying antenna configuration or design may be adapted or scaled for widely divergent frequencies. For example, a simple dipole antenna design may be scaled to operate at frequencies from the 3–4 MHz band up to the 100 MHz band and beyond.

At lower frequencies the options for antennas become fewer because the wavelengths become very long. Yet there is a significant interest in providing antennas for such lower frequencies including the Extremely Low Frequency (ELF) band, that is less than 3 kHz, the Very Low Frequency (VLF) band including signals from 20 kHz to 60 kHz and the Low Frequency (LF) band with frequencies in the 90 to 100 kHz band. However, conventional half-wave and quarter-wave antenna designs are difficult to implement because at 100 Hz, for example, a quarter-wave length is of the order of 750 km.

Notwithstanding these difficulties, antennas for such frequencies are important because they are useful in specific applications, such as effective communications with a submerged submarine. For such applications, conventional ELF antennas comprise extremely long, horizontal wires extended over large land areas. Such antennas are expensive to construct and practically impossible to relocate at will. An alternative experimental Vertical Electric Dipole (VEP) antenna uses a balloon to raise one end of a wire into the atmosphere to a height of up to 12 km or more. Such an antenna can be relocated. To be truly effective the antenna should extend along a straight line. Winds, however, can deflect both the balloon and wire to produce a catenary form that degrades antenna performance. Other efforts have been directed to the development of a corona mode antenna. This antenna utilizes the corona discharges of a long wire to radiate ELF signals.

Still other current communication methods for such submarine and other underwater environments include the use of mast mounted antennas, towed buoys and towed submersed arrays. While each of these methods has merits, each presents problems for use in an underwater environment. The mast of current underwater vehicles performs numerous sensing and optical functions. Mast mounted antenna systems occupy valuable space on the mast which could be used for other purposes. For both towed buoys and towed submersed arrays, speed must be decreased to operate the equipment. Consequently, as a practical matter, the use of such antennas for ELF or other low frequency communications is not possible because they require too much space.

Conventional plasma antennas are of interest for communications with underwater vessels since the frequency, pattern and magnitude of the radiated signals are proportional to the rate at which the ions and electrons are displaced. The displacement and hence the radiated signal can be controlled by a number of factors including plasma density, tube geometry, gas type, current distribution, applied magnetic field and applied current. This allows the antenna to be physically small, in comparison with traditional antennas. Studies have been performed for characterizing electromagnetic wave propagation in plasmas. Therefore, the basic concepts, albeit for significantly different applications, have been investigated.

With respect to plasma antennas, U.S. Pat. No. 1,309,031 to Hettinger discloses an aerial conductor for wireless signaling and other purposes. The antenna produces, by various means, a volume of ionized atmosphere along a long beam axis to render the surrounding atmosphere more conductive than the more remote portions of the atmosphere. A signal generating circuit produces an output through a discharge or equivalent process that is distributed over the conductor that the ionized beam defines and that radiates therefrom.

U.S. Pat. No. 3,404,403 to Vellase et al. uses a high power laser for producing the laser beam. Controls repeatedly pulse and focus the laser at different points thereby to ionize a column of air. Like the Hettinger patent, a signal is coupled onto the ionized beam.

U.S. Pat. No. 3,719,829 to Vaill discloses an antenna constructed with a laser source that establishes an ionized column. Improved ionization is provided by means of an auxiliary source that produces a high voltage field to increase the initial ionization to a high level to form a more highly conductive path over which useful amounts of electrical energy can be conducted for the transmission of intelligence or power. In the Hettinger, Vellase et al. and Vaill patents, the ionized columns merely form vertical conductive paths for a signal being transmitted onto the path for radiation from that path.

U.S. Pat. No. 3,914,766 to Moore discloses a pulsating plasma antenna, which has a cylindrical plasma column and a pair of field exciter members parallel to the column. The location and shape of the exciters, combined with the cylindrical configuration and natural resonant frequency of the plasma column, enhance the natural resonant frequency of the plasma column, enhance the energy transfer and stabilize the motion of the plasma so as to prevent unwanted oscillations and unwanted plasma waves from destroying the plasma confinement.

U.S. Pat. No. 5,450,223 to Wagner et al. discloses an optical demultiplexer for optical/RF signals. The optical demultiplexer includes an electro-optic modulator that modulates a beam of light in response to a frequency multiplexed radio-frequency information signal.

U.S. Pat. No. 5,594,456 to Norris et al. discloses an antenna device for transmitting a short pulse duration signal of predetermined radio frequency. The antenna device includes a gas filled tube, a voltage source for developing an electrically conductive path along a length of the tube which corresponds to a resonant wavelength multiple of the predetermined radio frequency and a signal transmission source coupled to the tube which supplies the radio frequency signal. The antenna transmits the short pulse duration signal in a manner that eliminates a trailing antenna resonance signal. However, as with the Moore antenna, the band of frequencies at which the antenna operates is limited since the tube length is a function of the radiated signal.

Notwithstanding the disclosures in the foregoing references, applications for ELF frequencies still use conventional land-based antennas. There remains a requirement for an antenna that can be mast mounted or otherwise use significantly less space than the existing conventional land-based antennas for enabling the transmission of signals at various frequencies, included ELF and other low-frequency signals, for transmission in an underwater environment.

SUMMARY OF THE INVENTION

Accordingly it is an object of the present invention to provide an antenna capable of operation with ELF signals.

Another object of this invention is to provide an antenna that is capable of transmitting signals in different frequency ranges including the ELF range.

Still another object of this invention is to provide an ELF antenna that is transportable.

Yet another object of this invention is to provide an ELF antenna that can be mounted in a restricted volume.

In accordance with this invention, an antenna radiates an electromagnetic field by generating a plasma with an ionizing beam in a vertically extended column. The ionizing beam is modulated in response to a modulating signal thereby to develop a modulated current in the vertically extended column that radiates electromagnetic energy.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
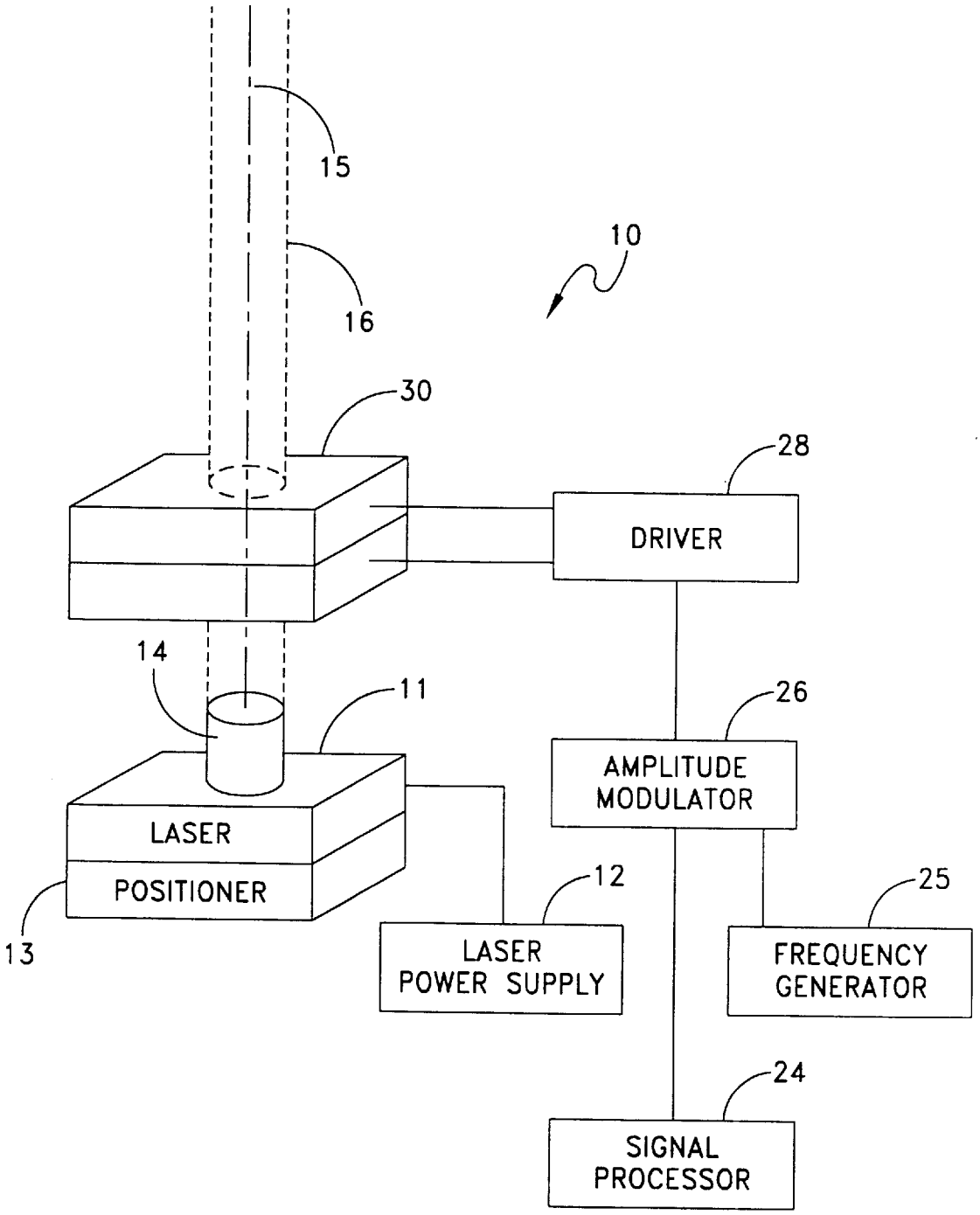
FIG. 1 depicts an embodiment of a plasma antenna according to this invention.
Figure 2:
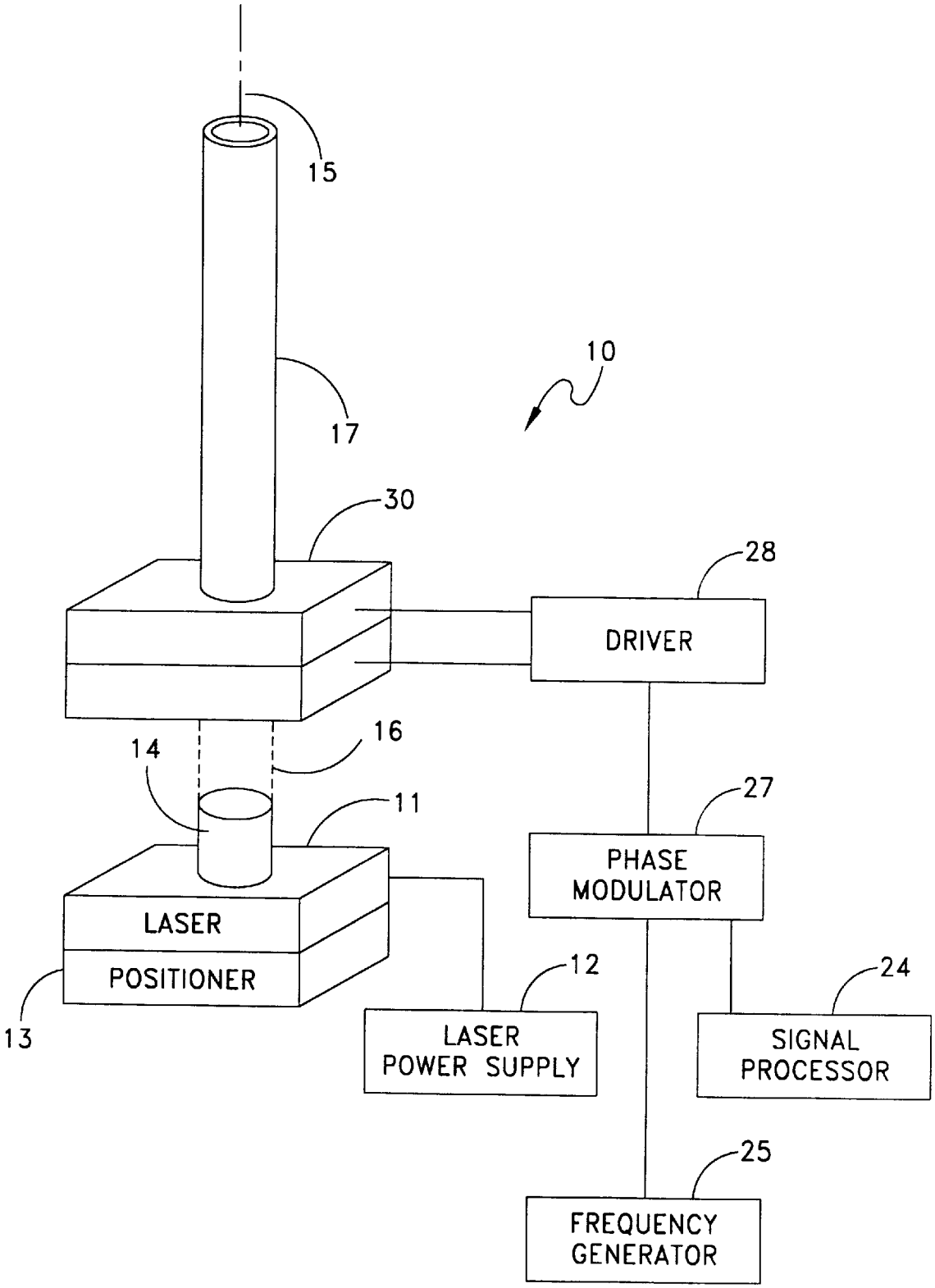
FIG. 2 depicts another embodiment of a plasma antenna according to this invention.

FIGS. 1 and 2 schematically depict two structures that form different embodiments of an antenna system 10 in accordance with this invention. In these particular embodiments the antenna system 10 includes an ionizing beam generator in the form of a laser 11 operated by a laser power supply 12 acting as an energizer for the ionized beam generator. A positioner 13 locates the laser 11 so that the emitted laser beam from an output aperture 14 travels along a vertical axis 15 into the atmosphere.

When the laser 11 is active, the laser beam interacts with a medium above it to form an ionized plasma column 16. The plasma column 16 comprises ions and electrons as known in the art. This column may be unbounded as shown in FIG. 1 or bounded as by an extended tube 17 in FIG. 2.

A basic criterion for providing such an antenna system 10 is that the plasma column 16 have an electron density of at least 1012 electrons per cubic centimeter in at least a portion of the column. Although it may possible to provide that level of ionization over time intervals associated with ELF frequencies, such continuous wave devices for use in antennas are prohibitively expensive. Pulse mode lasers offer a better option as ionizers. In FIGS. 1 and 2 the laser 11 comprises a $CO_2$, Nd:YAG or other laser. Typically these lasers operate in a pulse mode with a pulse repetition frequency that is much higher than ELF. For example, a $CO_2$ laser may operate with a pulse repetition frequency (PRF) in the megahertz range; one such $C0_2$ laser operates at about 67 MHz with a 33% duty cycle.

Figure 3:
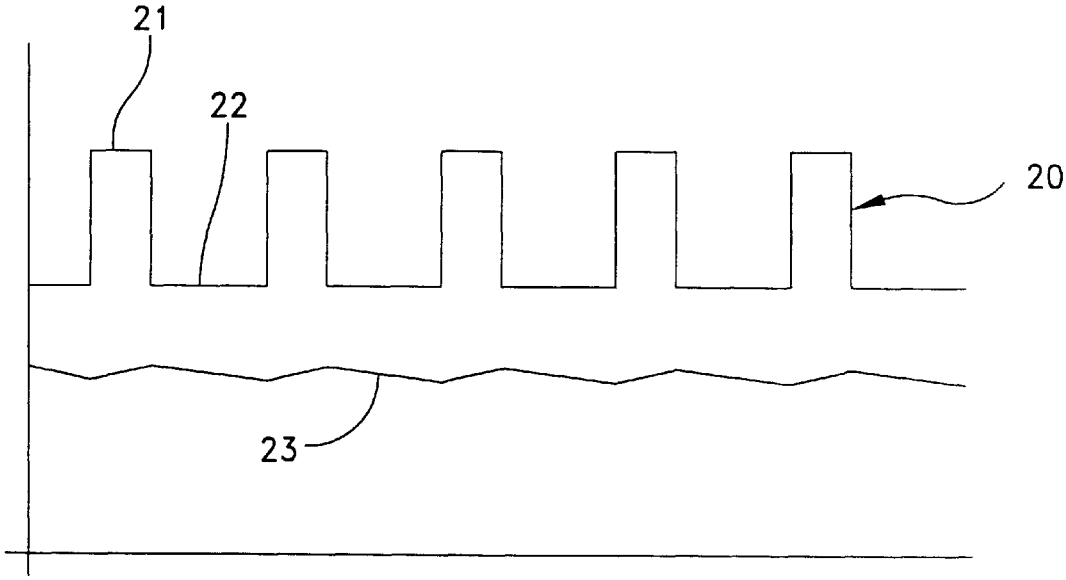
FIG. 3 comprises a set of graphs that are useful in understanding this invention.

As the laser power supply 12 generates continuous pulses, the laser beam ionizes the air in the column 16 to form the plasma. More specifically, FIG. 3 depicts this action by showing a pulse train 20 at some pulse repetition frequency with the pulse train shifting between an ON level 21 and OFF level 22. The OFF time 22, between successive pulses in the pulse train 20 is selected to limit the amount of relaxation between successive pulses. For example, the interval is chosen to limit the relaxation to about 10% of the maximum ionization. A graph 23 in FIG. 3 shows the effect on the level of ionization of repetitive pulses having an OFF time corresponding to above criterion. Although there is a minor variation in the ionization level in the plasma column during successive pulses, that variation is less than about 10% of the maximum ionization. Therefore, the variation is insignificant with respect to the operation of this invention.

FIGS. 1 and 2 also depict a signal processor 24 that produces an output signal containing information to be transmitted. A frequency generator 25 provides a carrier frequency in some desired frequency range. This frequency range may be at any frequency including an ELF frequency.

In FIG. 1 an amplitude modulator 26 combines the signals from the signal processor 24 and the frequency generator 25 to produce an amplitude-modulated signal. In FIG. 2 a phase modulator circuit 27 combines the signals from the signal processor 24 and frequency generator 25 to produce a phase- or frequency-modulated output signal.

In either form, a driver 28 receives the amplitude-modulated or phase- or frequency-modulated signal from the corresponding modulator. The driver applies a potential to an electro-optical crystal 30. As is generally known, an electro-optical crystal 30 will respond to the signals from the driver 28 by shifting the phase or intensity of the photons in the laser beam. Thus, the introduction of the electro-optical crystal 30 allows the driver to phase or amplitude modulate the laser beam before the laser beam initiates any significant ionization.

As the modulated laser beam passes through the plasma column 16, it will produce various potential gradients that will cause the charge carriers in the plasma to oscillate at the modulation frequency, e.g., 100 Hz. Thus plasma will undergo changes in frequency or magnitude depending upon a frequency or magnitude of the signal applied by the driver 28. Assuming that the voltage applied to the electro-optical crystal 30 is an alternating voltage, the currents will be generated in a vertical direction reversing at the same frequency as the polarity of the signal reverses. Consequently this current generates an AC electromagnetic field that radiates electromagnetic energy from the column 16 with the frequency determined by the frequency generator 25. Moreover, the intensity or phase of this electromagnetic field will vary in accordance with the amplitude or phase changes produced by the modulating signal from either the amplitude modulator 26 or the phase modulator 27.

It has been determined that this plasma current, $I_P$, will have a much greater magnitude than the current $I_A$ in a conventional antenna. As previously indicated, conventional ELF antennas have a length $L_A$ that is quite long. In accordance with conventional antenna analysis, two antennas provide equal radiation if they have an equal I*L product where I is the current in the antenna and L is the length of the antenna. Assuming the conventional antenna has a length LA, the length $L_P$ of the plasma antenna will be:

$$L_P = I_A / I_P \, L_A \quad (1)$$

Thus, if the plasma generates a current $I_P$ that has a greater magnitude than the current $I_A$ of a conventional antenna, the length $L_P$ of the plasma antenna can be decreased by a corresponding amount. For applications in which the plasma column 16 in FIG. 1 reaches well into the atmosphere a combination of increased current and length may provide even greater field strengths than presently available in ELF applications. It is expected that the plasma current for a given frequency will be up to 2 to 5 times or more the corresponding antenna current.

At ELF and other low frequencies a column 16 will effectively be terminated at the ionosphere. Electrically the ionosphere acts as a reflector with respect to the impedance characteristics of the plasma. Consequently the plasma column 16 acts as a standing wave antenna just as conventional wire antennas operate in the ELF frequency range.

At higher frequencies, it may possible to shorten the antenna to allow the use of the tube 17. This tube length would be selected to provide a column length which maximizes the energy radiated from the column within a practical physical length limit. If the column is closed, the upper end will define a reflector to assure that the antenna also operates as a standing wave antenna. As known, standing wave antennas allow the radiation of electromagnetic fields without requiring a length corresponding to even a quarter wave length for the transmitted signal, such as an ELF signal from the signal processor 24. The antenna with a bounded column operates in the same manner as an antenna with an unbounded column.

Therefore there has been disclosed in the foregoing figures an antenna in which an ionizing beam generator, such as a laser, produces an ion plasma column. A modulator mechanism, such as an electro-optical crystal, is placed so the laser beam transfers through the electro-optical crystal before entering the ion plasma column. A modulator provides a driving signal to the electro-optical crystal thereby to alter the amplitude or phase of the photons in the laser beam to produce gradients in the ion column. Consequently the ion column produces currents that radiate an electromagnetic field at the frequency of the modulating signal that varies in amplitude or phase amplitude or phase variations of the modulating signal.

As the only hardware associated with the antenna includes the laser, laser power supply, electro-optical crystal, signal processor, modulator and electro-optical crystal drivers, this construction provides a compact, transportable antenna structure even for ELF applications. Moreover, this invention enables the construction of an antenna that is significantly shorter than a conventional antenna for the same frequency.

This invention has been described in terms of specific implementations. Different lasers and different laser power supply operations and different signal processor operations can all be incorporated in a plasma antenna that relies upon an electro-optical crystal to modulate a laser beam thereby to produce currents that are radiated in an alternating electromagnetic field as an amplitude or a phase modulated field having a frequency determined by the modulating signal. Therefore, it is the intent of the appended claims to cover all such variations and modifications as come within the true spirit and scope of this invention.

What is claimed is:

1. An antenna comprising:

an ionizing beam generator for directing an ionizing beam vertically;

means for energizing said ionizing beam generator thereby to produce a vertically extending plasma column; and modulating means disposed in the ionizing beam intermediate the plasma column and said ionizing beam generator for modulating the ionizing beam thereby to produce a modulated current in the vertically extending plasma column that radiates electromagnetic energy.

2. An antenna as recited in claim 1 wherein said ionizing beam generator comprises a laser.

3. An antenna as recited in claim 1 wherein said ionizing beam generator comprises a laser that, when operated by said energizing means, generates a plasma in at least a portion of the column with a concentration of at least $10^{12}$ electrons per cubic centimeter.

4. An antenna as recited in claim 3 wherein said laser is taken from the group of $CO_2$ and Nd:YAG lasers.

5. An antenna as recited in claim 3 wherein said laser is taken from the group of $CO_2$ and Nd:YAG lasers and wherein said energizing means operates said laser in a continuous wave mode.

6. An antenna as recited in claim 3 wherein said laser is taken from the group of $CO_2$ and Nd:YAG lasers and wherein said energizing means operates said laser in a pulsed mode.

7. An antenna as recited in claim 1 wherein said modulating means comprises:

means for generating a modulating signal;

electro-optical crystal means disposed to intercept the laser beam between said laser and said column; and a modulator circuit responsive to the modulating signal for energizing said electro-optical crystal means in response thereto, whereby said electro-optical crystal means introduces gradients in the plasma that cause charge carriers in the plasma to oscillate vertically and radiate electromagnetic energy from the antenna.

8. An antenna as recited in claim 7 wherein said modulator circuit comprises a phase modulator.

9. An antenna as recited in claim 7 wherein said modulator circuit comprises an amplitude modulator.

10. An antenna as recited in claim 7 additionally comprising means for defining a bounded, vertically extending column.

11. An antenna as recited in claim 7 wherein said ionizing beam generator comprises a laser that, when operated by said energizing means, generates a plasma column with a concentration of electrons of at least $10^{12}$ electrons per cubic centimeter in at least a portion of the column.

12. An antenna as recited in claim 11 wherein said laser is taken from the group of $CO_2$ and Nd:YAG lasers.

13. An antenna as recited in claim 11 wherein said laser is taken from the group of $CO_2$ and Nd:YAG lasers and wherein said energizing means operates said laser in a CW mode.

14. An antenna as recited in claim 11 wherein said laser is taken from the group of $CO_2$ and Nd:YAG lasers and wherein said energizing means operates said laser in a pulsed mode.

15. A method for radiating electromagnetic energy into the atmosphere comprising the steps of:

directing an ionizing beam vertically through the atmosphere to produce a vertically directed plasma column; and modulating the ionizing beam prior to its entry into the column thereby to produce a modulated current in the vertically extending plasma column that radiates electromagnetic energy.

16. A method as recited in claim 15 wherein said ionizing beam directing step includes producing an concentration of electrons of at least $10^{12}$ electrons per cubic centimeter in at least a portion of the column.

17. A method as recited in claim 16 wherein said ionizing beam directing step includes energizing a laser taken from the group of $CO_2$ and Nd:YAG lasers in a CW mode.

18. A method as recited in claim 16 wherein said ionizing beam directing step includes energizing laser taken from the group of $CO_2$ and Nd:YAG lasers in a pulsed mode.

19. A method as recited in claim 16 additionally comprising the step of physically bounding the column.

* * * * *